US010527375B1

(12) United States Patent
Mokuolu

(10) Patent No.: US 10,527,375 B1
(45) Date of Patent: Jan. 7, 2020

(54) AUTOMATIC FIREARM MAGAZINE LOADER

(71) Applicant: Richard Mokuolu, East Garrison, CA (US)

(72) Inventor: Richard Mokuolu, East Garrison, CA (US)

( * ) Notice: Subject to any disclaimer, the term of this patent is extended or adjusted under 35 U.S.C. 154(b) by 0 days.

(21) Appl. No.: 15/897,221

(22) Filed: Feb. 15, 2018

Related U.S. Application Data

(62) Division of application No. 14/392,365, filed on Feb. 1, 2016, now Pat. No. 9,939,218.

(60) Provisional application No. 61/886,062, filed on Oct. 3, 2013.

(51) Int. Cl.
*F41A 9/83* (2006.01)

(52) U.S. Cl.
CPC ..... *F41A 9/83* (2013.01)

(58) Field of Classification Search
CPC ..... F41A 9/01; F41A 9/82; F41A 9/84; B65G 7/18; B65G 7/19; B65G 7/20
USPC ..... 42/87; 89/33.5
See application file for complete search history.

(56) References Cited

U.S. PATENT DOCUMENTS 2,345,593 A * 4/1944 Garand ..... F41A 9/83 86/47
2,394,033 A * 2/1946 Wossum ..... F41A 9/83 42/87
2,451,521 A * 10/1948 Uglum ..... F41A 9/83 244/155 A
4,739,572 A * 4/1988 Brandenburg ..... F41A 9/83 42/87
4,939,862 A * 7/1990 Brandenburg ..... F41A 9/83 42/87
4,949,495 A * 8/1990 Mari ..... F41A 9/83 42/87
7,059,077 B2 * 6/2006 Tal ..... F41A 9/83 42/88
2013/0125737 A1 * 5/2013 Koskela ..... B65G 47/1457 86/45
2013/0152771 A1 * 6/2013 Coma Asensio .. B65G 47/1457 86/19.5

* cited by examiner

*Primary Examiner* — Bret Hayes

(57) ABSTRACT

The present invention is an automatic firearm magazine loader that has an elevated hopper system, a loading system, and a mechanism for compressing a firearm magazine comprising a spring mechanism. The firearm magazine is compressible upon compression of the spring mechanism. The loading system facilitates the loading of a firearm ammunition into the firearm magazine upon the compression of the firearm magazine, and the compression of the firearm magazine is motor driven. The device is an automatic firearm magazine loader for a designated number of rounds of ammunition. The design consists of a user interface used to select the preferred number of rounds of ammunition to load, a hopper system which feeds individual rounds of ammunition in a set orientation, and a loading system which loads the individual rounds of ammunition into a firearm magazine.

9 Claims, 11 Drawing Sheets

AUTOMATIC FIREARM MAGAZINE LOADER

CROSS-REFERENCE TO RELATED APPLICATIONS

The present application is a divisional application of U.S. application Ser. No. 14/392,365, filed Feb. 1, 2016, which itself claims priority to PCT application PCT/US2014/058855, filed Oct. 2, 2014, and which claims the benefit under 35 USC 119(e) to U.S. Provisional Application No. 61/886,062, filed Oct. 3, 2013.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to the field of firearms. More particularly, the present invention relates to a method and device for facilitating the loading of firearm ammunition into a firearm magazine.

2. Description of the Related Art

Firearm magazines are difficult and oftentimes ergonomically challenging to load by hand. This is time consuming, can be painful for the user, and requires the user to remove gloves in cold weather. The difficulties of loading firearm magazines even with the use of a hand loader are multiplied for users with certain conditions. Further, current loaders require user input which can lead to injury.

Current firearm magazine loaders such as the UpLULA Speed Loader (U.S. Pat. No. 7,637,048; Dec. 29, 2009; Tal, Guy (Rosh Ha'ayin, IL)) require orientation of ammunition by the user prior to loading the firearm magazine. This loading process is time consuming and stressful for the user. Another magazine loader such as the Caliber Magazine Loader (U.S. Pat. No. 5,301,449; Apr. 12, 1994; Jackson, Terry R. (Bozeman, Mont.)) requires the user to manually load the firearm magazine by rotating a cam. This loading process is also time consuming and can fatigue the user.

BRIEF SUMMARY OF THE INVENTION

The present invention is an automatic firearm magazine loading device for users to load their firearm magazines automatically through the use of a hopper and loading system. Power for this device is preferably provided by an electrical outlet or battery pack.

This summary of the invention does not necessarily describe all features of the invention.

BRIEF DESCRIPTION OF THE SEVERAL VIEWS OF THE DRAWINGS

These and other features of the invention will become more apparent from the following description in which reference is made to the appended drawings wherein.

REFERENCE NUMERALS IN THE DRAWINGS

| | | | |
|---|---|---|---|
| 10 | automatic firearm magazine loading device | 12 | hopper base |
| 14 | stationary hopper ring | 16 | hopper ramp |
| 18 | optical sensor | 20 | hopper rotor base |
| 22 | hopper hub | 24 | hopper disc |
| 26 | hopper agitator | 28 | hopper wall |
| 30 | bullet stop | 32 | servo motor |
| 34 | hopper mount | 36 | hopper chute |
| 38 | rotating arm | 40 | motor drive gear |
| 42 | thumb screw | 44 | magazine slide |
| 46 | motor mount | 48 | base |
| 50 | potentiometer | 52 | firearm magazine |
| 54 | hopper lid | 56 | hopper basket |
| 58 | hopper stand | 60 | loading chute |
| 62 | loading channel | 64 | micro actuator connector |
| 66 | loading arm | | |
| 70 | magazine housing | 68 | micro linear actuator |
| 74 | actuator connector | 72 | loading insert |
| 78 | toggle clamp | 76 | linear actuator |
| 82 | adjustable backing plate | 80 | clamp base |

DETAILED DESCRIPTION OF VARIOUS EMBODIMENTS OF THE INVENTION

Various embodiments of the invention are described more fully hereinafter with reference to the accompanying drawings, in which some, but not all embodiments of the invention are shown in the figures. Indeed, these inventions may be embodied in many different forms and should not be construed as limited to the embodiments set forth herein; rather, these embodiments are provided so that this disclosure will satisfy applicable legal requirements.

Figure 1:
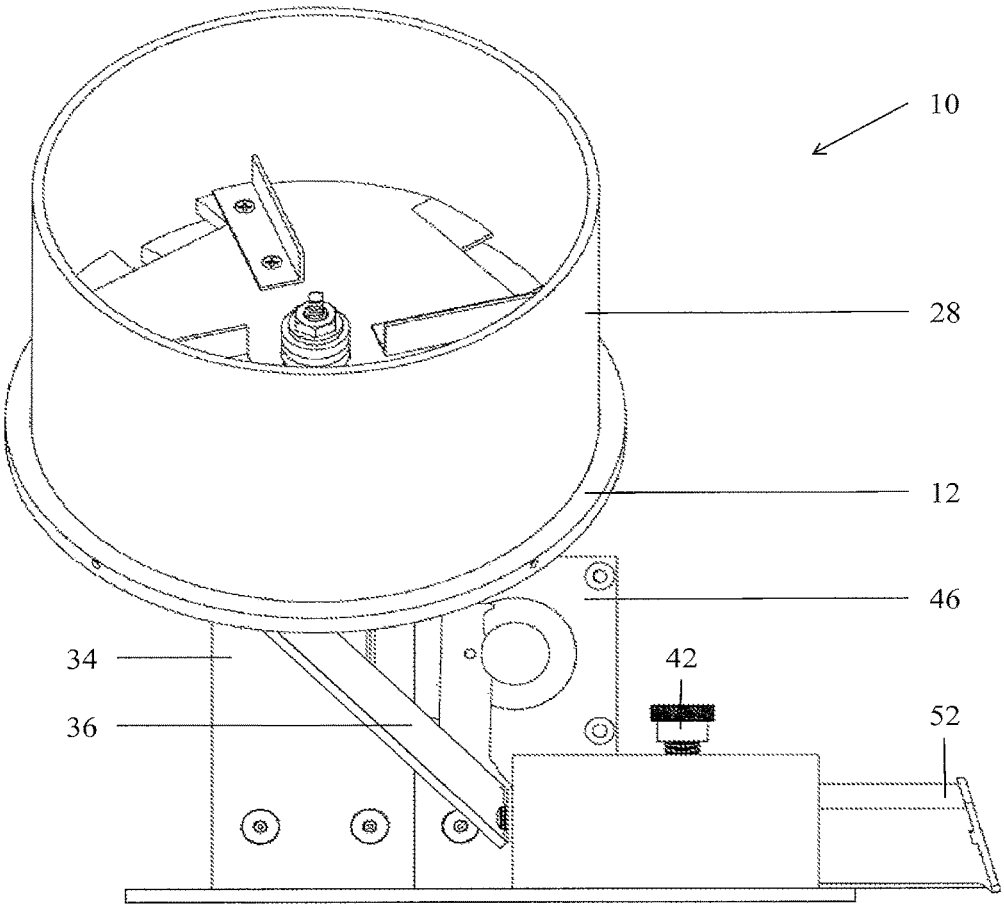
FIG. 1 is a front view of a first embodiment of an automatic firearm magazine loading device of the present invention.
Figure 2:
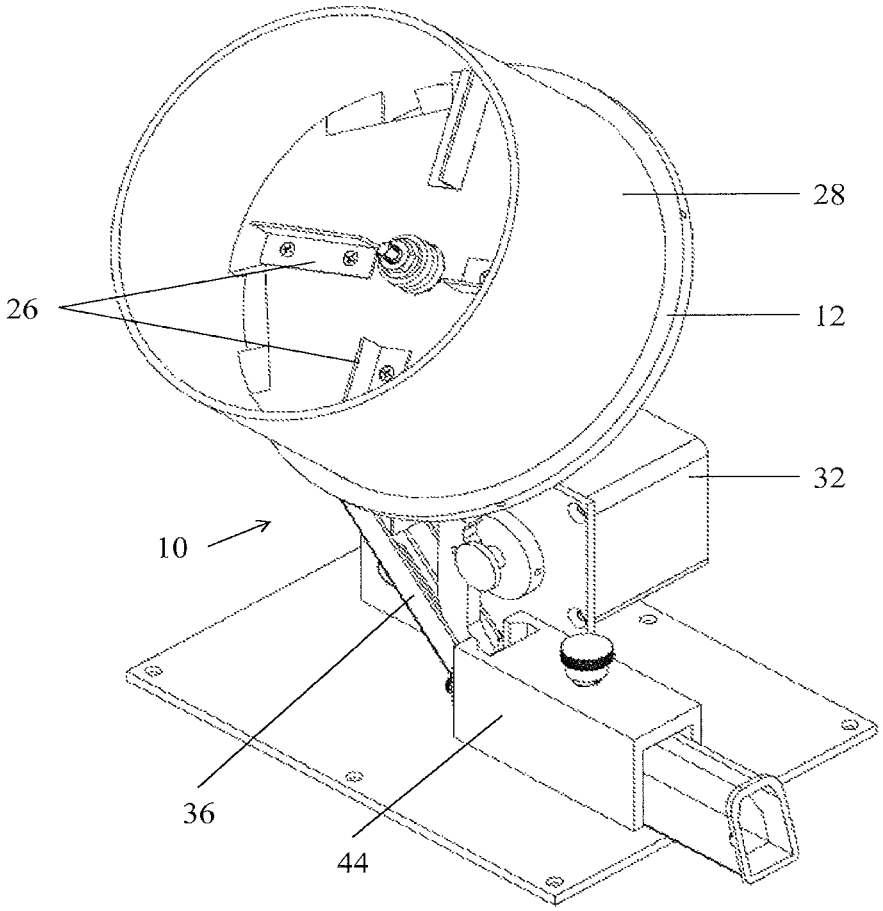
FIG. 2 is an isometric view of the first embodiment of an automatic firearm magazine loading device of FIG. 1.
Figure 3:
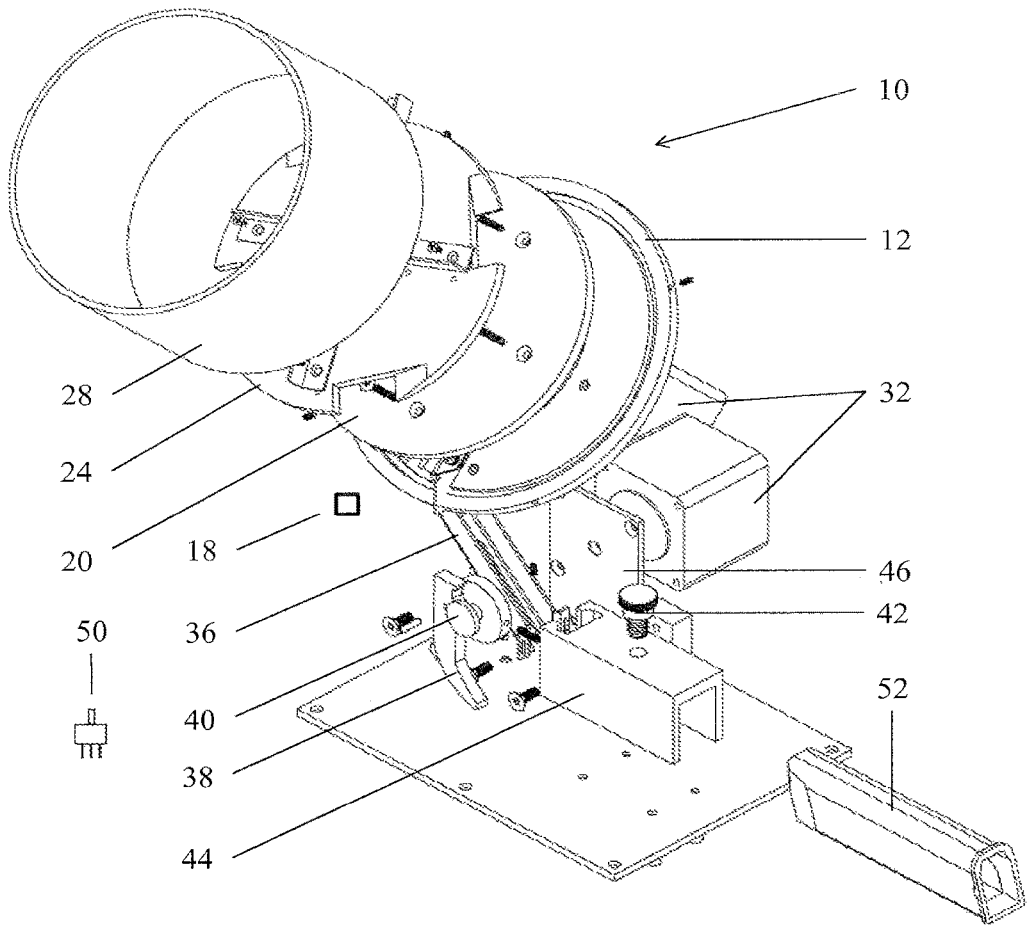
FIG. 3 is an exploded isometric view of the first embodiment of an automatic firearm magazine loading device of FIG. 1.
Figure 4:
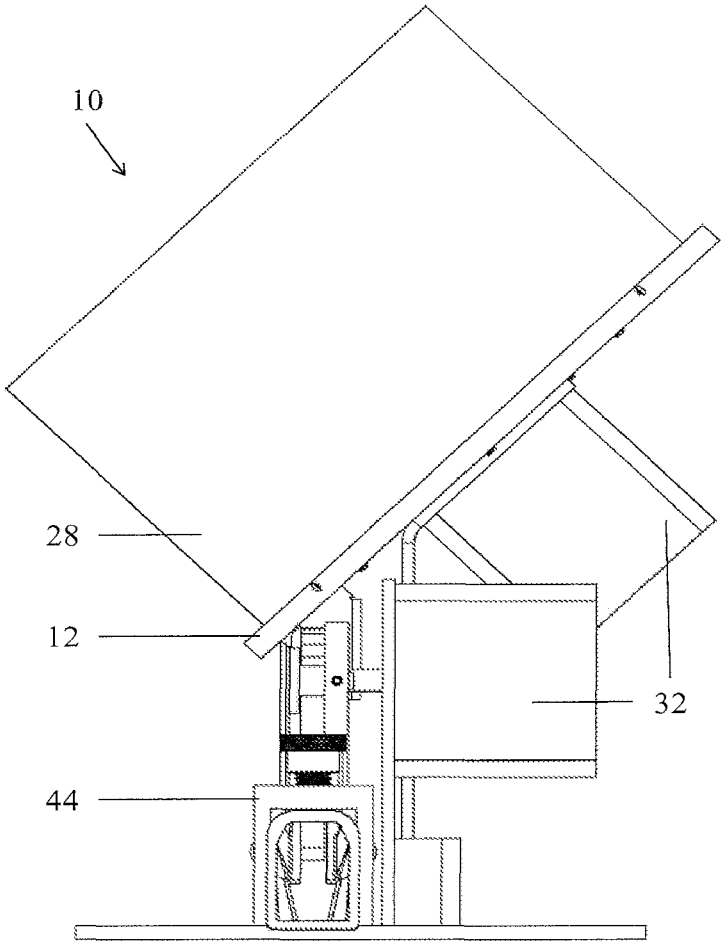
FIG. 4 is a side view of the first embodiment of an automatic firearm magazine loading device of FIG. 1.
Figure 5:
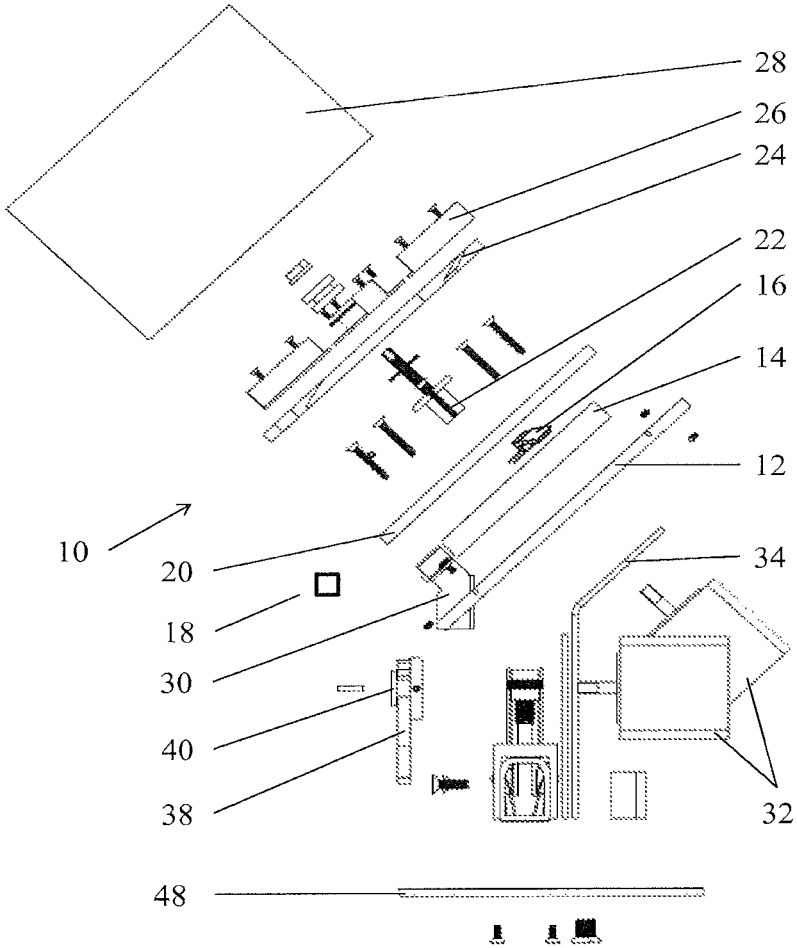
FIG. 5 is an exploded side view of the first embodiment of an automatic firearm magazine loading device of FIG. 1.

A first embodiment of the present invention is shown in detail in FIG. 1, FIG. 2, FIG. 3, FIG. 4, and FIG. 5. Disclosed is an automatic firearm magazine loading device 10 shown with an elevated hopper system placed at a 45 degree angle, and a motor loading system. The hopper system comprises of a hopper base 12, stationary hopper ring 14, hopper ramp 16, optical sensor 18, hopper rotor base 20, hopper hub 22, hopper disc 24, hopper agitator 26, hopper wall 28, bullet stop 30, a servo motor 32, hopper mount 34, and hopper chute 36. The motor loading system comprises of a servo motor 32, rotating arm 38, motor drive gear 40, thumb screw 42, magazine slide 44, and motor mount 46. Both the hopper system and motor loading system are built on a base 48.

In more detail, still referring to the invention of FIG. 1, FIG. 2, FIG. 3, FIG. 4, and FIG. 5, the motor loading system compresses the spring of the firearms magazine 46 for loading using a servo motor 32, motor drive gear 40, and rotating arm 38. The firearm magazine 52 is compressed when the loading servo motor 32 rotates the motor drive gear 40 counterclockwise, forcing the rotating arm 38 to compress the spring within the firearm magazine 52. The thumb screw 42 connected to the magazine slide 44 is tightened to ensure the firearm magazine 52 does not move during the loading process. After the spring of the firearm magazine 52 has been compressed by the rotating arm 38, the hopper system picks up individual rounds of ammunition in a specific orientation. This is done by using a servo motor 32 to rotate the hopper disc 24 and hopper agitator 26 in a clockwise motion. The hopper hub 22 is used as a connection between the servo motor 32 and rotating hopper disc 24. Correctly orientated rounds of ammunition are then dropped through the hopper rotor base 20 into a gap between the stationary hopper ring 14 and hopper wall 28 via the hopper ramp 16. Incorrectly orientated rounds of ammunition are re-orientated via the hopper ramp 16 in order to ensure ammunition orientation accuracy. The correctly orientated round of ammunition is then transported past the optical sensor 18 which obtains information on the round of ammunition. After the round passes the optical sensor 18, it is then directed to the hopper chute 36 by the bullet stop 30. The round of ammunition is then transported by the hopper chute 36 to the firearm magazine 52 which is already compressed by the rotating arm 38. Once the round of ammunition is in the firearm magazine 52, the loading servo motor 32 rotates the motor drive gear 40 clockwise, which forces the rotating arm 38 to decompress the spring of the firearm magazine 52 without removing the round of ammunition from the firearm magazine 52. The spring of the firearm magazine 52 is then compressed again by the rotating at in 38 with the already loaded round of ammunition in the firearm magazine 52. This process is repeated until the automatic firearm magazine loading device 10 has loaded the set number of rounds of ammunition determined by the user by using a user interface and/or if the firearm magazine 52 is full. A user interface is represented by a potentiometer 50. However, a user interface can be a keypad or touch screen. Once the loading process is complete, the firearm magazine 52 is removed from the magazine slide 44 by using the thumb screw 42.

Figure 6:
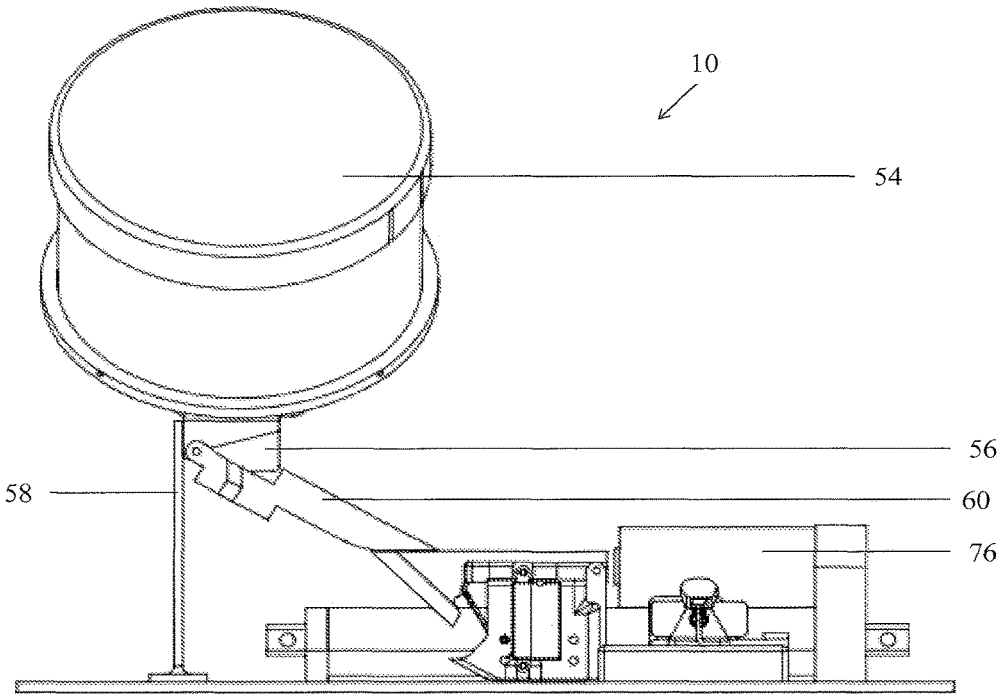
FIG. 6 is a front view of a second embodiment of an automatic firearm magazine loading device of the present invention.
Figure 7:
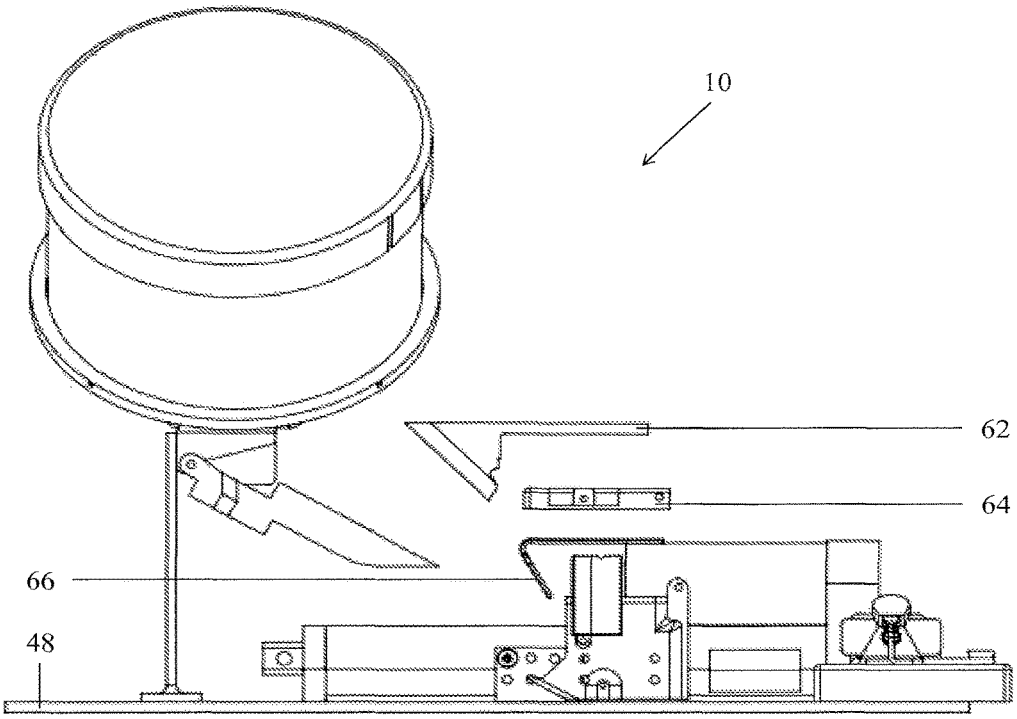
FIG. 7 is an exploded front view of the second embodiment of an automatic firearm magazine loading device of FIG. 6.
Figure 8:
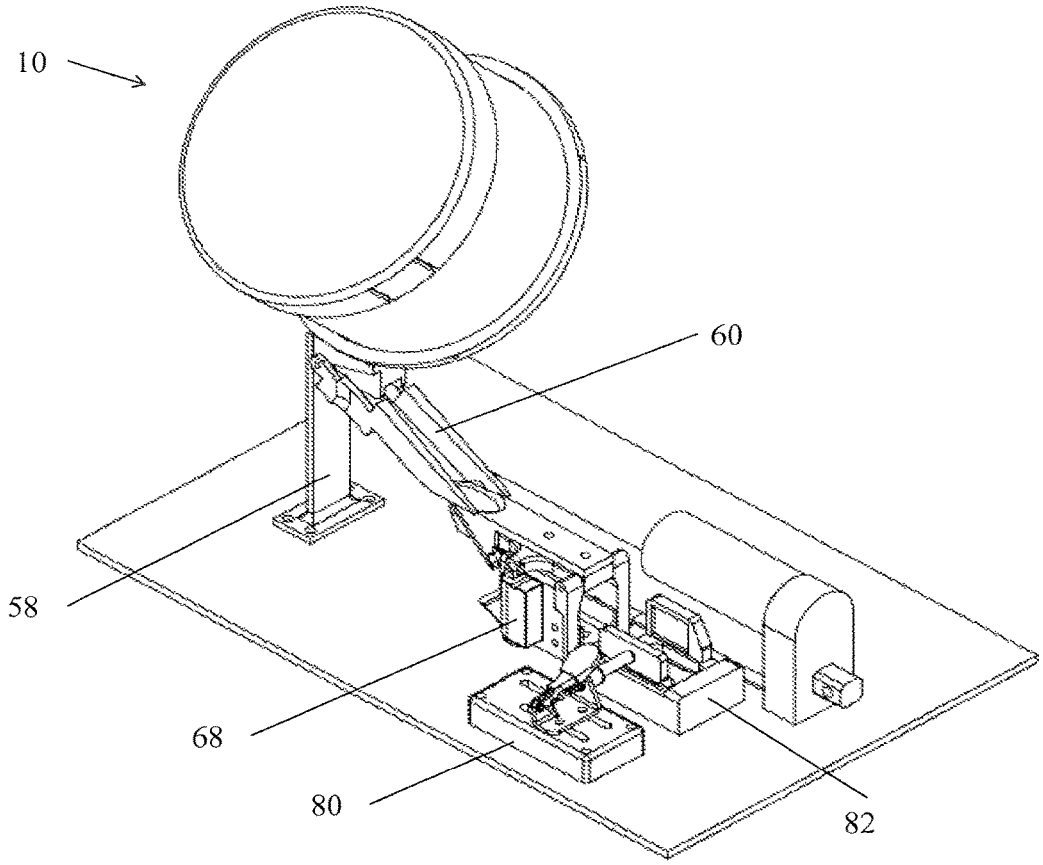
FIG. 8 is an isometric view of the second embodiment of an automatic firearm magazine loading device of FIG. 6.
Figure 9:
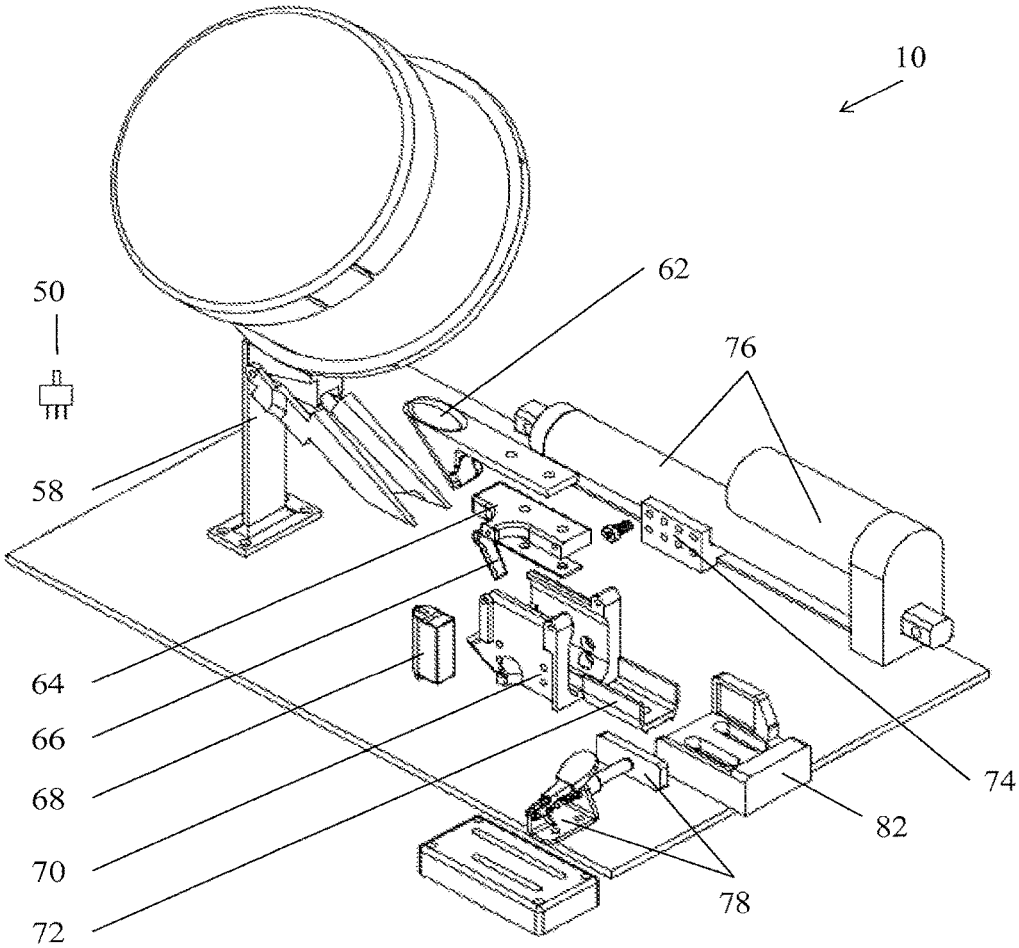
FIG. 9 is an exploded isometric view of the second embodiment of an automatic firearm magazine loading device of FIG. 6.
Figure 10:
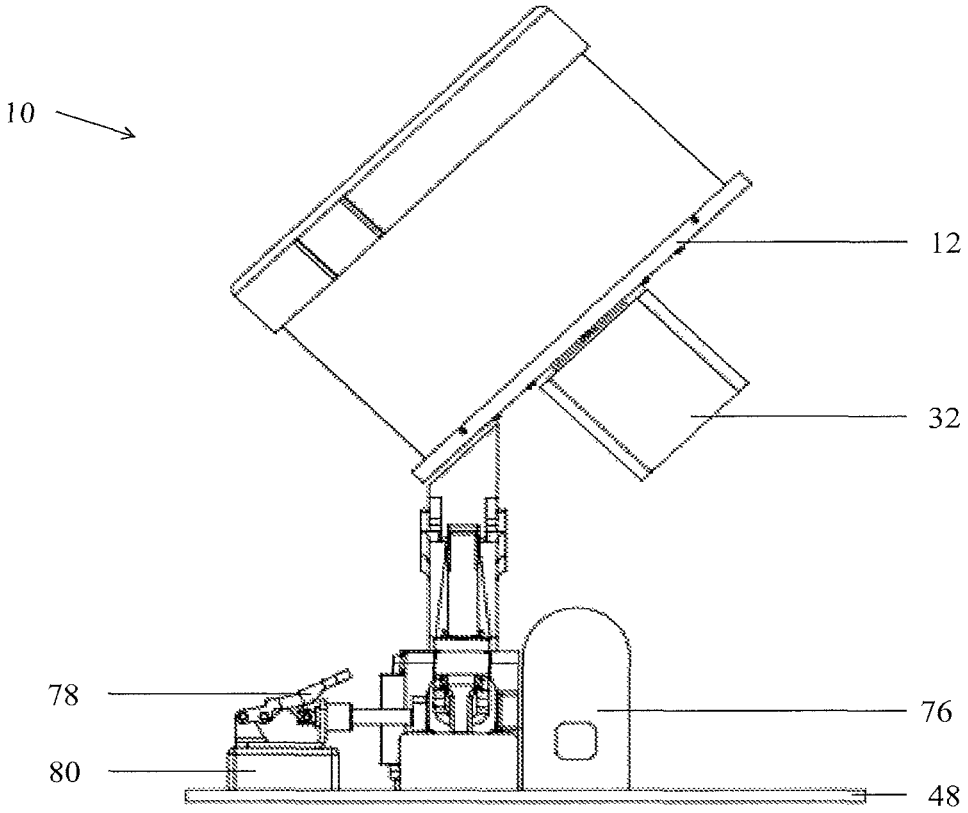
FIG. 10 is a side view of the second embodiment of an automatic firearm magazine loading device of FIG. 6.
Figure 11:
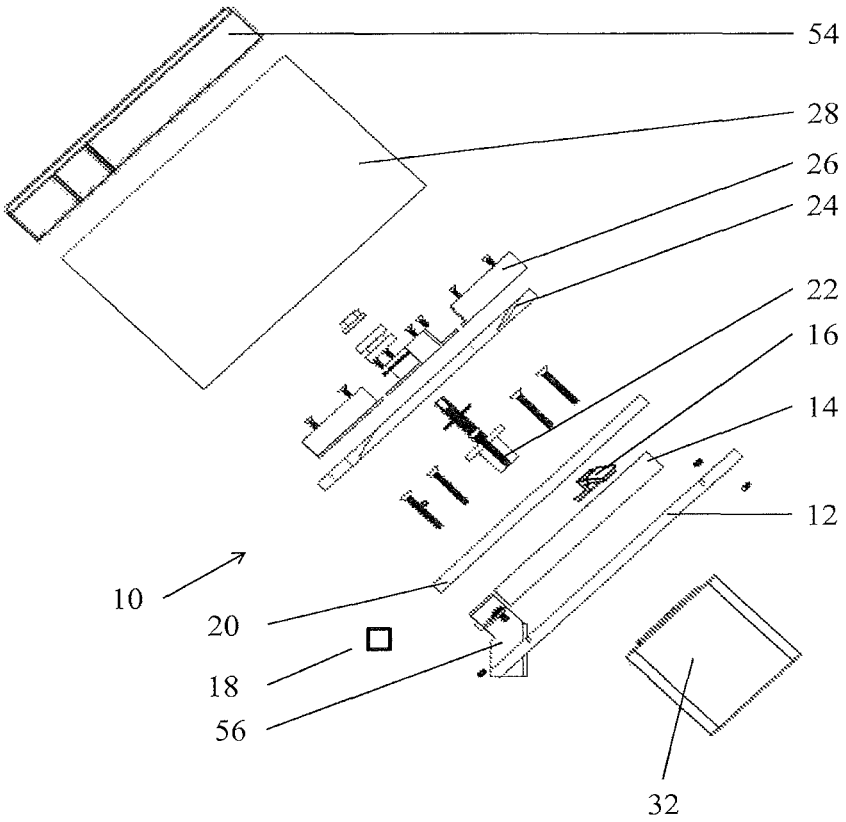
FIG. 11 is an exploded side view of the hopper system of an automatic firearm magazine loading device of FIG. 6.

A second embodiment of the present invention is shown in detail in FIG. 6, FIG. 7, FIG. 8, FIG. 9, FIG. 10, and FIG. 11. Disclosed is an automatic firearm magazine loading device 10 with an elevated hopper system placed at a 45 degree angle, and an actuator loading system. The hopper system comprises of a hopper base 12, stationary hopper ring 14, hopper ramp 16, optical sensor 18, hopper rotor base 20, hopper hub 22, hopper disc 24, hopper agitator 26, hopper wall 28, a servo motor 32, hopper lid 54, hopper basket 56, hopper stand 58, and loading chute 60. The actuator loading system comprises of a loading channel 62, micro actuator connector 64, loading arm 66, micro linear actuator 68, magazine housing 70, loading insert 72, actuator connector 74, linear actuator 76, toggle clamp 78, clamp base 80, and adjustable backing plate 82. Both the hopper system and actuator loading system are built on a base 48.

In more detail, still referring to the invention of FIG. 6, FIG. 7, FIG. 8, FIG. 9, FIG. 10, and FIG. 11, the firearm magazine 52 is loaded into the magazine housing 70 by using the toggle clamp 78 and adjustable backing plate 82. The position of the toggle clamp 78 and adjustable backing plate 82 of the actuator loading system is then adjusted to the appropriate position according to the type of firearm magazine 52 being loaded. The loading insert 72 is also adjusted to the type of firearm magazine 52 being loaded. Once the appropriate position of the toggle clamp 78 and adjustable backing plate 82 has been fixed and the firearm magazine 52 has been clamped in place, rounds of ammunition are then poured into the hopper system. The hopper lid 54 is then used to seal the hopper system once the ammunition has been poured into the hopper system. The actuator loading system compresses the spring of the firearm magazine 52 for loading using a micro actuator connector 64, micro linear actuator 68, loading arm 66, magazine housing 70, and linear actuator 76. The micro actuator connector 64 connects the micro linear actuator 68 to the loading arm 66 and controls compression of the spring in the firearm magazine 52 by the actuator shaft extending or retracting vertically. The linear actuator 76 is connected to the magazine housing 70 via the actuator connector 74 which is also connected to the loading arm 66 and controls compression of the spring in the firearm magazine 52 by the actuator shaft extending or retracting horizontally. The firearm magazine 52 is compressed when the shaft of the linear actuator 76 and micro linear actuator 68 retracts, forcing the loading arm 66 to compress the spring within the firearm magazine 52. The toggle clamp 78 and adjustable backing plate 82 ensure the firearm magazine 52 does not move during the loading process. After the spring of the firearm magazine 52 has been compressed by the loading arm 66, the hopper system picks up individual rounds of ammunition in a specific orientation. This is done by using a servo motor 32 to rotate the hopper disc 24 and hopper agitator 26 in a clockwise motion. The hopper hub 22 is used as a connection between the servo motor 32 and rotating hopper disc 24. Correctly orientated rounds of ammunition are then dropped through the hopper rotor base 20 into a gap between the stationary hopper ring 14 and hopper wall 28 via the hopper ramp 16. Incorrectly orientated rounds of ammunition are re-orientated via the hopper ramp 16 in order to ensure ammunition orientation accuracy. The correctly orientated round of ammunition is then transported past the optical sensor 18 which obtains information on the round of ammunition. After the round passes the optical sensor, it is then directed to the loading chute 60 by the hopper basket 56. The hopper basket 56 also re-orientates any incorrectly orientated round of ammunition which may have passed through the hopper ramp 16 in order to ensure ammunition orientation accuracy. The correctly orientated round of ammunition is then transported by the loading chute 60 and loading channel 62 to the firearm magazine 52 which is already compressed by the loading arm 66. The loading channel 62 is connected to the loading arm 66 and ensures the round of ammunition is loaded properly into the firearm magazine 52. Once the round of ammunition is in the firearm magazine 52, the shaft of the micro linear actuator 68 and linear actuator 76 extends, which forces the loading arm 66 to decompress the spring of the firearm magazine 52 without removing the round of ammunition from the firearm magazine 52. The spring of the firearm magazine 52 is then compressed again by the loading arm 66 with the already loaded round of ammunition in the firearm magazine 52. The loading chute 60 rotates during the compression and decompression of the firearm magazine 52 in order to avoid interference of moving components. This process is repeated until the automatic firearm magazine loading device 10 has loaded the set number of rounds of ammunition determined by the user by using a user interface and/or if the firearm magazine is full. A user interface is represented by a potentiometer 50. However, a user interface can be a keypad or touch screen. Once the loading process is complete, the firearm magazine 52 is removed from the magazine housing 70 by using the toggle clamp 78.

The user interface is used to control the hopper and loading systems. The user interface is controlled by the user and utilizes user feedback to load the firearm magazine 52. This is done via input from a control panel or component which controls the automatic firearm magazine loading device 10. For the sake of satisfying the requirements of this application, the user interface for the disclosed automatic firearm magazine loading device 10 is represented by a potentiometer 50. By way of example and without limitation, the user interface may be a touch screen, LCD screen, potentiometer, keypad, or any such component which could be used to obtain user input.

In a further embodiment, the present invention is an automatic firearm magazine loader comprising an elevated hopper system and a loading system having a rotating arm. The rotating arm is adapted to compress a firearm magazine comprising a spring mechanism, which is compressible upon compression of the spring mechanism. The loading system facilitates the loading of a firearm ammunition into the firearm magazine upon the compression of the firearm magazine, and the compression of the firearm magazine by the rotating arm is motor driven.

In a further embodiment, the present invention is an automatic firearm magazine loader having a hopper system and a loading system, in which the hopper system is oriented at about a 45 degree angle relative to said loading system.

In a further embodiment, the present invention is an automatic firearm magazine loader with a hopper system comprising a hopper disc, a hopper agitator, and a gap in the hopper system. In this embodiment, the hopper disc and the hopper agitator are rotated in a manner resulting in exposure of the gap, thereby allowing a round of ammunition in the hopper system to drop through the gap to the loading system. The rotation of the hopper disc and the hopper agitator is motor driven.

In a further embodiment, the present invention is an automatic firearm magazine loader having a hopper system with a hopper ramp, a stationary hopper ring, a hopper wall, a hopper basket, and a hopper chute, with a gap formed in the hopper system being formed between the stationary hopper ring and the hopper wall. The round of ammunition is transported to the loading system from the gap through the hopper basket and hopper chute.

In a further embodiment, the present invention is an automatic firearm magazine loader with a hopper system having a hopper ramp for ensuring proper orientation of the round of ammunition.

In a further embodiment, the present invention is an automatic firearm magazine loader with a hopper system having an optical sensor for obtaining information on the round of ammunition.

In a further embodiment, the present invention is an automatic firearm magazine loader with a hopper system having a hopper basket for ensuring proper orientation of the round of ammunition.

In a further embodiment, the present invention is an automatic firearm magazine loader with a user interface for controlling the hopper and loading systems.

In a further embodiment, the present invention is an automatic firearm magazine loader with a hopper system that comprises a hopper hub, wherein said hopper hub connects a rotatable hopper disc to a motor in a manner permitting the rotation of the hopper disc to be motor driven.

In a further embodiment, the present invention is an automatic firearm magazine loader with a servo motor.

In a further embodiment, the present invention is an automatic firearm magazine loader having a servo motor which drives the rotation of a hopper disc and the compression of the firearm magazine in a manner resulting in the firearm magazine being compressed in time to receive a round of ammunition from the hopper system.

In a further embodiment, the present invention is an automatic firearm magazine loader in which the firearm magazine is slidably associated with a magazine slide, and wherein the magazine slide comprises a thumb screw which is tightened to secure the firearm magazine within the magazine slide to prevent movement of the firearm magazine during the process of loading the magazine.

In a further embodiment, the present invention is an automatic firearm magazine loader comprising an elevated hopper system and a loading system. The loading system comprises a magazine housing, a micro linear actuator and linear actuator connected to the magazine housing, a loading insert, a loading arm, a micro actuator connector, a loading channel, an actuator connector, a toggle clamp, and an adjustable backing plate. The firearm magazine is loaded into the magazine housing and secured in place between the toggle clamp and the backing plate. The loading arm is adapted to compress a firearm magazine when the micro linear actuator and linear actuator are refracted. The firearm magazine has a spring mechanism, and is compressible upon compression of the spring mechanism. In the embodiment, the loading system facilitates the loading of a firearm ammunition into the firearm magazine upon the compression of the firearm magazine, and the micro linear actuator and linear actuator motion is motor driven.

In a further embodiment, the present invention is an automatic firearm magazine loader with a servo motor that drives the rotation of the hopper disc and the retraction of the linear actuators in a manner resulting in the firearm magazine being compressed in time to receive a round of ammunition from the hopper system.

In a further embodiment, the present invention is an automatic firearm magazine loader comprising an elevated hopper system and a loading system having a rotating arm. The rotating arm is adapted to compress a firearm magazine comprising a spring mechanism, which is compressible upon compression of the spring mechanism. The loading system facilitates the loading of a firearm ammunition into the firearm magazine upon the compression of the firearm magazine, and the compression of the firearm magazine by the rotating arm is motor driven.

In a further embodiment, the present invention comprises a firearm having an automatic firearm magazine loader comprising an elevated hopper system and a loading system. The loading system comprises a magazine housing, a micro linear actuator and linear actuator connected to the magazine housing, a loading insert, a loading arm, a micro actuator connector, a loading channel, an actuator connector, a toggle clamp, and an adjustable backing plate. The firearm magazine is loaded into the magazine housing and secured in place between the toggle clamp and the backing plate. The loading arm is adapted to compress a firearm magazine when the linear actuators are retracted. The firearm magazine has a spring mechanism, and is compressible upon compression of the spring mechanism. In the embodiment, the loading system facilitates the loading of a firearm ammunition into the firearm magazine upon the compression of the firearm magazine, and the linear actuator extension is motor driven.

In further detail, still referring to the invention of FIGS. 1-11, the hopper disc 24 possesses machined slots with a minimum thickness of about 0.06 inches and maximum thickness of about 0.24 inches. The gap between the hopper wall 28 and stationary hopper ring 14 is sufficiently wide enough to allow ammunition to be transported to the hopper chute 36 or loading chute 60, such as about 0.47 inches deep and about 0.6 inches wide. The hopper chute 36 and loading chute 60 is sufficiently wide enough to allow ammunition to be transported to the loading system, such as about 0.6 inches wide. Dimensions of each individual component will differ according to the type of ammunition being loaded.

The construction details of the invention as shown in FIGS. 1-11 are that the hopper system and loading system may be made of metal or of any other sufficiently rigid and strong material such as high-strength plastic, and the like. Further, the various components of the hopper system and loading system can be made of different materials.

The advantages of the present invention include, without limitation, that it automates the loading of firearm magazines which offers the user saved time and ergonomic benefits. Compared with current firearm magazine loading devices, the present invention requires little input from the user, saves on time spent loading a firearm magazine, and avoids calluses and other conditions which arise from manual loading of firearm magazines.

In broad embodiment, the present invention is a firearm magazine loader which loads various firearm magazines.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed. Moreover, the terms "consisting", "comprising" and other derivatives from the term "comprise" are intended to be open-ended terms that specify the presence of any stated features, elements, steps, or components, and are not intended to preclude the presence or addition of one or more other features, elements, integers, steps, components, or groups thereof. Moreover, Applicants have endeavored in the present specification and drawings to draw attention to certain features of the invention, it should be understood that the Applicant claims protection in respect to any patentable feature or combination of features referred to in the specification or drawings. The drawings are provided to illustrate features of the invention, but the claimed invention is expressly not limited to the illustrated embodiments.

I claim:

1. An automatic firearm magazine loader comprising an elevated hopper system and a loading system, wherein said loading system comprises (1) a magazine housing, (2) a linear actuator connected to said magazine housing, (3) a loading arm, (4) a toggle clamp, (5) an adjustable backing plate, and (6) a loading insert, wherein a firearm magazine is loaded into said magazine housing and secured in place between said toggle clamp and said backing plate, wherein said loading arm is adapted to compress a spring mechanism comprised within said firearm magazine when said linear actuator is retracted, wherein said linear actuator retraction/extension is motor driven, wherein said loading system facilitates the loading of a firearm ammunition into said firearm magazine upon the compression of said spring mechanism comprised within said firearm magazine, and wherein said loading insert is shaped in a manner to allow for adequate positioning of said firearm magazine within said magazine housing.

2. The automatic firearm magazine loader of claim 1, wherein said hopper system comprises (1) a hopper disc, (2) a hopper agitator, (3) a gap in said hopper system, and (4) a hopper ramp wherein said hopper disc and said hopper agitator are rotated in a manner resulting in exposure of said gap, thereby allowing a round of ammunition in said hopper system to drop through said gap to said loading system, wherein said rotation of said hopper disc and said hopper agitator is motor driven, and wherein said hopper ramp is shaped in a manner resulting in re-orientation of a round of ammunition in said hopper system to drop through said gap to said loading system.

3. The automatic firearm magazine loader of claim 2, wherein said hopper system further comprises (1) a stationary hopper ring, (2) a hopper wall, (3) a loading chute, and (4) a hopper basket wherein said gap in said hopper system is formed between said stationary hopper ring and said hopper wall, wherein said round of ammunition is transported to said loading system from said gap through said loading chute, and wherein said hopper basket is shaped in a manner resulting in re-orientation of a round of ammunition from said hopper system to drop through said loading chute to said loading system.

4. The automatic firearm magazine loader of claim 3, wherein said hopper system further comprises an optical sensor for obtaining information on the round of ammunition.

5. The automatic firearm magazine loader of claim 4, further comprising a user interface for controlling said hopper and loading systems.

6. The automatic firearm magazine loader of claim 5, wherein said user interface is selected from the group consisting of a touch screen, LCD screen, potentiometer, keypad, or other user input component.

7. The automatic firearm magazine loader of claim 3, wherein said hopper system further comprises a hopper hub, wherein said hopper hub connects said rotatable hopper disc to said motor in a manner permitting the rotation of said hopper disc to be motor driven.

8. The automatic firearm magazine loader of claim 7, wherein said motor is a servo motor.

9. The automatic firearm magazine loader of claim 8, wherein said servo motor drives the rotation of the hopper disc and the extension of said linear actuator in a manner resulting in said spring mechanism comprised within said firearm magazine being compressed in time to receive a round of ammunition from said hopper system.

* * * * *